United States Patent [19]

Fleming, Jr. et al.

[11] Patent Number: 4,719,735

[45] Date of Patent: Jan. 19, 1988

[54] TRANSLUCENT END CAP

[75] Inventors: Harry A. Fleming, Jr., Smethport; Robert L. Wehman, Port Allegany, both of Pa.

[73] Assignee: Pittsburgh Corning Corporation, Pittsburgh, Pa.

[21] Appl. No.: 31,509

[22] Filed: Mar. 27, 1987

[51] Int. Cl.[4] ..... E04C 1/42

[52] U.S. Cl. ..... 52/306

[58] Field of Search ..... 52/306-308, 52/605, 608, DIG. 10; 404/34; 446/85; D25/72

[56] References Cited

U.S. PATENT DOCUMENTS

| | | | |
|---|---|---|---|
| 1,425,102 | 8/1922 | Keppler | 52/306 |
| 1,994,387 | 3/1935 | Despret | 52/306 |
| 2,086,185 | 7/1937 | Keaney | 52/306 |
| 2,306,320 | 12/1942 | Rapp | 52/306 |
| 2,975,853 | 3/1961 | Friend | 52/306 X |
| 3,798,861 | 3/1974 | Weiss | 52/306 |
| 4,023,319 | 5/1977 | Kurata | 52/308 |
| 4,651,486 | 3/1987 | Erickson et al. | 52/306 |

*Primary Examiner*—J. Karl Bell

*Attorney, Agent, or Firm*—Stanley J. Price, Jr.

[57] ABSTRACT

A translucent end cap which may be secured to an abutting side surface of a translucent block includes a pair of parallel top and bottom surfaces each having generally the same preselected shape. A side surface extends between the top and bottom surfaces and is perpendicular and joined to the top and bottom surfaces. The side surface has a contour generally conforming to the preselected shaped of the top and bottom surfaces. A raised rear surface portion extends from the side surface to form a protrusion. A portion of this protrusion is arranged to abut a portion of an abutting side surface of a translucent glass block to provide a mortar joint between the end capside surface and the abutting side surface of a translucent glass block. The end caps are secured to exposed top or side abutting surfaces of translucent blocks form a translucent block wall structure to provide a translucent block wall structure having usable top or side surfaces.

17 Claims, 5 Drawing Figures

TRANSLUCENT END CAP

BACKGROUND OF THE INVENTION

1. Field Of The Invention

This invention relates to an end cap, and more particularly, to translucent end caps which may be secured to exposed top or side abutting surfaces of translucent blocks which form a translucent block wall structure to provide a translucent block wall structure having usable top or side surfaces.

2. Description Of The Prior Art

The use of translucent block, such as glass block, for exterior and interior applications is well known. Using block for various wall structures offers various aesthetic and design possibilities, as well as provides various functional characteristics and advantages over other materials which may be used for similar purposes. For example, glass block structures promote energy conservation through their insulating capability to reduce heat gain or loss and provide thermal efficiencies for energy conservation. Additionally, glass block structures can control light transmission and glare, as well as reduce surface condensation, draft and noise transmission. Because of their construction, glass block structures offer security advantages while maintaining light transmission therethrough. Lastly, glass block structures have the added advantage of ease of maintenance and installation.

Although translucent blocks may be utilized with excellent results to form various wall structures, it is often desired to form a translucent block wall structure which is used as a room or office divider or other wall structure which does not extend vertically from floor to ceiling. Typically, translucent block wall structures which form room or office dividers are between four and six courses of block in height. Similarly, translucent block wall structures may include passageways to permit pedestrian travel between partitioned room or office sections.

As is known in the art, each individual block in the wall structure normally includes four abutting side surfaces positioned between the block side faces. Each glass four abutting side surface includes two surfaces each tapered inwardly from an outside edge of the glass block to meet at the center of the abutting side surface.

As a result, if it is desired to form a translucent block wall structure to serve as a room or office divider which is only between four and six courses high, the top surface of the translucent block divider, which is composed of a plurality of glass block abutting side surfaces, has a generally inwardly tapered configuration. In similar fashion, a pedestrian passageway formed in the block wall structure has a vertically extending side surface composed of a plurality of stacked, vertically extending glass block abutting side surfaces.

Normally, the exposed top or side surface of the block divider is covered with either a finished wood or metallic sheet material to provide top and side surfaces, respectively, which may be usable for other purposes. For example, the top surface of the block divider may be covered with a wood or decorative sheet material to provide a generally flat divider top surface which may be used as a shelf or for other suitable purposes. The pedestrian passageway vertically extending side surface may also be covered with wood or sheet material to provide a generally flat vertical side surface for use with a room divider door.

Although wood or decorative metallic sheet material may be used to cover the top or side exposed abutting surfaces of a translucent block wall structure, these various coverings are difficult to secure to the block abutting side surfaces and detract from the otherwise generally aesthetically pleasing appearance of the block wall structure.

Accordingly, there remains a need for a translucent end cap which may be conveniently secured to an abutting side surface of a translucent block to provide that an exposed top or side abutting surface of a translucent block which forms a part of a translucent block wall structure forms top or side surfaces respectively which do not require wood or similar coverings to form usale top or side surfaces. The translucent end cap is preferably formed from the same translucent glass material as the translucent glass block and has the same decorative design as the translucent glass block.

SUMMARY OF THE INVENTION

In accordance with the present invention, there is provided a translucent end cap for use with a translucent glass block. The translucent end cap includes a pair of top and bottom surfaces spaced from each other. The top and bottom surfaces are substantially parallel to each other and have generally the same preselected shape. A side surface extends between the top and bottom surfaces and is perpendicular and joined to the top and bottom surfaces. The side surface has a contour generally conforming to the preselected shape of the top and bottom surfaces. A raised rear surface portion extends from the side surface to form a protrusion. A portion of this protrusion abuts a portion of an abutting side surface of a translucent glass block.

Further, in accordance with the present invention, there is provided a translucent end cap for use with a translucent glass block which includes a pair of parallel upper and lower faces each having a generally rectangular first portion and a generally trapezoidal second portion extending from and integral with the generally rectangular first portion. A first pair of generally rectangular, opposing side faces are parallel with each other and are perpendicular and joined to the upper and lower faces rectangular first portions. A second pair of generally rectangular side faces are perpendicular and joined to the upper and lower faces trapezoidal second portions. One of the first pair of side faces is joined to one of the second pair of side faces with a first predetermined angle therebetween. A generally rectangular end face is perpendicular and joined to the upper and lower faces trapezoidal second portions. The generally rectangular end face is positioned between and joined to the second pair of side faces with a second predetermined angle between the end face and each of the second pair of side faces. A generaly rectangular opposite end face is positioned opposite and parallel with the end face. The opposite end face is perpendicular and joined to the upper and lower faces rectangular first portions. The opposite end face is positioned between and joined with the first pair of side faces. The generally rectangular opposite end face includes a raised surface portion which extends from the opposite end face to form a protrusion. A portion of the protrusion abuts a portion of an abutting side surface of a translucent glass block.

Accordingly, it is an object of the present invention to provide a translucent end cap which may be secured to an abutting side surface of a translucent glass block.

An additional object of the present invention is to provide a translucent end cap formed from parallel top and bottom surfaces each having the same general preselected shape and connected by means of a side surface having a raised surface portion which abuts an abutting side surface of a translucent glass block.

A further object of the present invention is to provide a translucent end cap having a pair of parallel upper and lower faces, each face having a generally rectangular first portion and a generally trapezoidal second portion extending from an integral with the generally rectangular first portion. The end cap includes a plurality of side faces extending between and connected to the pair of parallel upper and lower faces. The end cap also includes an end face and an opposite end face which are also connected between the pair of parallel upper and lower faces. The opposite end face includes a raised surface portion, a portion of which is arranged to contact a portion of an abutting side surface of a translucent glass block.

Another object of the present invention is to provide a translucent end cap which may be secured to an exposed top or side abutting surface of a translucent block which forms a part of a translucent block wall structure to provide a translucent block wall structure having usable top and side surfaces.

These and other objects of the present invention will be more completely disclosed and described in the following specification, the accompanying drawings and the appended claims.

DESCRIPTION OF THE PREFERRED EMBODIMENTS

Figure 1:
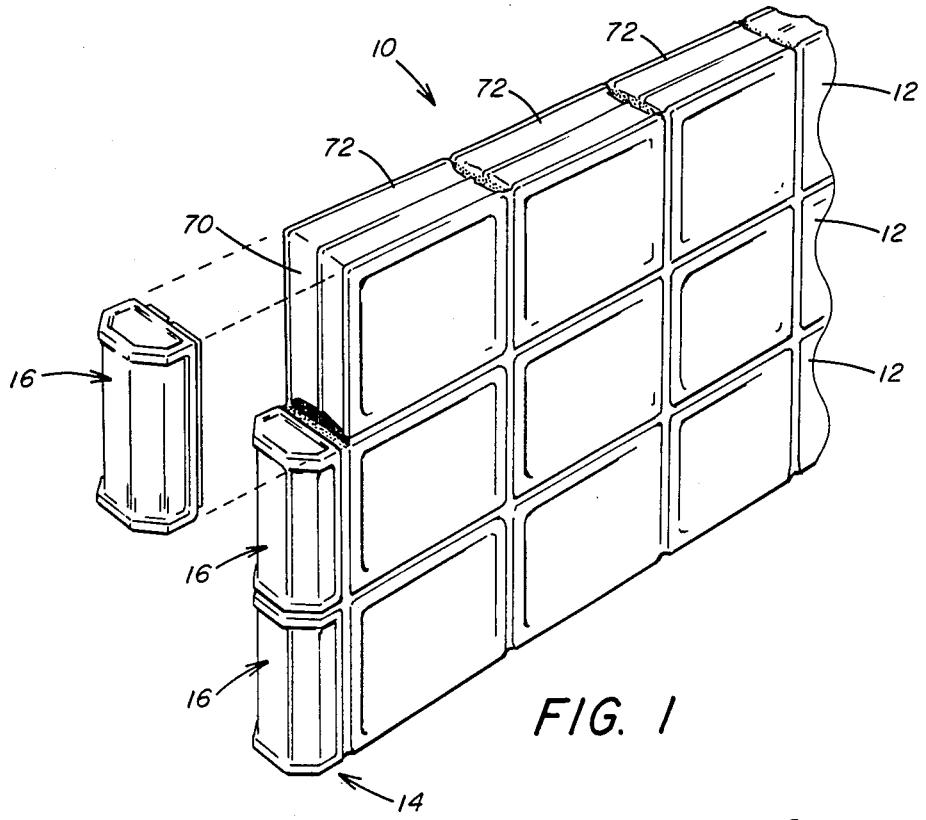
FIG. 1 is a perspective view of a portion of a translucent block wall structure having end caps which are the subject of this invention.

Referring to the drawings and particularly to FIG. 1, there is illustrated a translucent block wall structure 10, such as a glass block wall structure, having at least one layer of translucent block. The layers of translucent block are generally designated by the numeral 12. The translucent block wall structure 10 includes an end cap section 14 integrally joined with the straight translucent block wall sections. Although end cap section 14 is integrally joined with the straight translucent block wall sections, end cap section 14 is shown partially detached from the straight translucent block wall section in FIG. 1 to better illustrate end cap section 14.

To form the end cap section 14, the translucent block wall structure 10 includes a plurality of translucent end caps 16. End cap 16 is illustrated in greater detail in FIGS. 2 and 3.

The translucent end cap 16 has an upper face generally designated by the numeral 18 and a lower face generally designated by the numeral 24. Upper face 18 includes a generally rectangular first portion 20 and a generally trapezoidal second portion 22 integral with generally rectangular first portion 20. The lower face generally designated by the numeral 24 includes a rectangular first portion 26 and a generally trapezoidal second portion 28 integral with the rectangular first portion 26. As described, upper face 18 and lower face 24 have general configurations which are identical. The upper face 18 is shown in FIGS. 2 and 3 and the lower face 24 is indicated in FIGS. 2 and 3 although not specifically visible therein.

Figure 2:
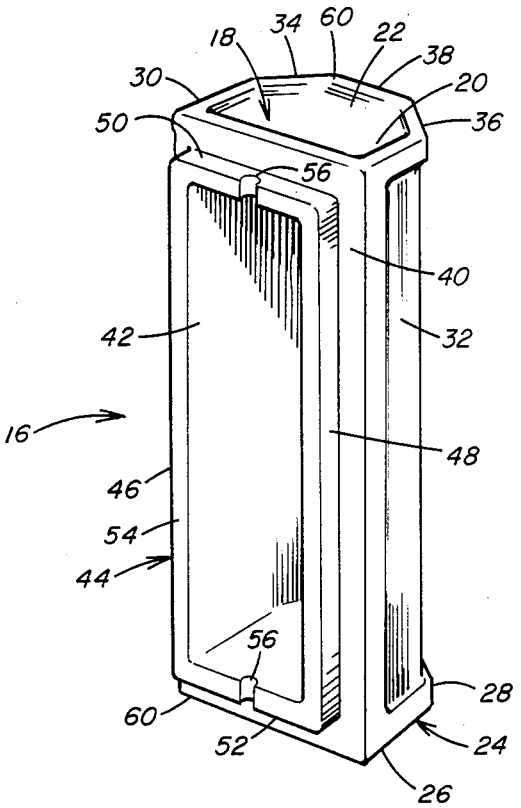
FIG. 2 is a perspective view of a translucent end cap of the present invention.
Figure 3:
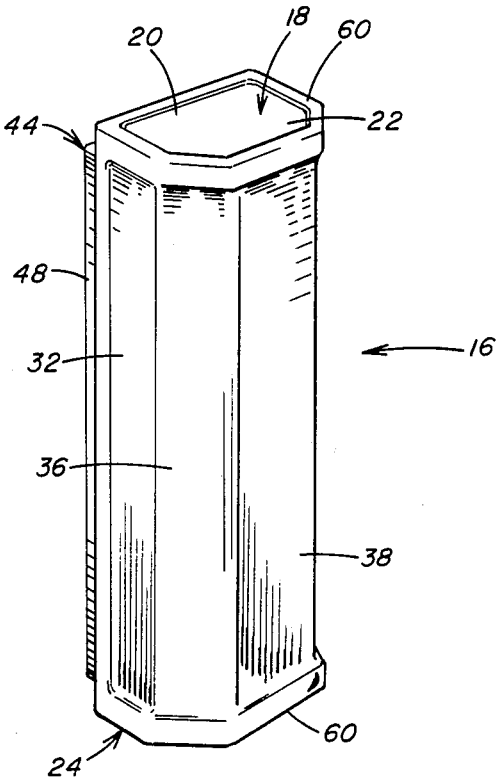
FIG. 3 is an other perspective view of a translucent end cap of the present invention.

The end cap 16 has two sides 30 and 32 of generally rectangular configuration as shown in FIG. 2. Sides 30 and 32 are oppositely positioned from each other on end cap 16 and are perpendicular and integrally joined to upper face 18 rectangular first portion 20 and lower face 24 rectangular first portion 26.

The end cap 16 includes two sides 34 and 36 of generally rectangular configuration. Sides 34 and 36 are perpendicular and integrally joined to upper face 18 trapezoidal second portion 22 and lower face 24 trapezoidal second portion 28.

The end cap 16 also includes an end face 38 of generally rectangular configuration. End face 38 is perpendicular and integrally joined to upper face 18 trapezoidal second portion 22 and lower face 24 trapezoidal second portion 28. As seen, end face 38 is positioned between side face 34 and side face 36, and integrally joined with side face 34 and side face 36.

The end cap 16 also has an opposite end face 40 of generally rectangular configuration which is perpendicular and integrally joined to upper face 18 rectangular first portion 20 and lower face 24 rectangular first portion 26. As seen, opposite end face 40 is integrally joined to side face 30 and side face 32 of end cap 16.

The end cap 16 also includes a cavity 42 positioned in opposite end face 40. Cavity 42 is formed during the end cap 16 forming process. It should be understood that although end cap 16 illustrated in the Figures includes cavity 42, an end cap such as end cap 16 may be formed from solid translucent glass. In this case, end cap 16 will not include cavity 42. The elimination of cavity 42 will not, however effect this invention.

As seen in FIG. 2, opposite end face 40 includes a raised surface portion generally designated by the numeral 44 which extends around the perimeter of cavity 42. The raised surface portion generally designated by the numeral 44 includes a pair of spaced walls 46 and 48 connected at their respective tops and bottoms by top wall 50 and bottom wall 52. As seen, each of the walls 46–52 has a generally rectangular cross-section.

Raised surface portion 44 includes a top surface portion 54 which is formed from the top surfaces of the walls 46–52. As seen in FIG. 2, top wall 50 and bottom wall 52 each include an arcuately notched portion 56 which extends from top surface protion 54 inwardly into top wall 50 and bottom wall 52, respectively. As will be explained later in greater detail, arcuately notched portions 56 and suitably positioned in top wall 50 and bottom wall 52 to prevent top wall 50 and bottom wall 52 from contacting a translucent glass block abutting surface raised surface portion.

Where desired, end cap 16 upper face 18 may include a raised surface portion 60 which extends around the perimeter of upper face 18. Although not shown in FIGS. 2 and 3, end cap 16 lower face 24 may also include a raised surface portion 60 which extends around the perimeter of lower face 24. As will be explained later in greater detail, raised surface portions 60 may be formed on end cap 16 to provide additional mortar-adhering surfaces between adjacent end caps 16 when the end caps 16 are joined to a column of translucent glass blocks such as shown in FIG. 1. However, raised surface portions 60 positioned on top face 18 and bottom face 24 are not essential to this invention.

As seen in FIGS. 2 and 3, side face 34 is integrally joined to side face 30 on end cap 16. Similarly, side face 36 is integrally joined to side face 32. Since side face 34 and side face 36 are connected between trapezoidal second portions 22 and 28, the adjacent sides 30, 34 and the adjacent sides 32, 36 respectively meet to form angles between adjacent sides. The angle between adjacent sides 30, 34 and the angle between adjacent sides 32, 36 are preferably equal, and are each greater than 90° but less than 180°. The angle between adjacent sides 30, 34 and the angle between adjacent sides 32, 36 may be varied between 90° and 180° to obtain an aesthetically pleasing end cap 16 to suit particular application requirements.

End face 38 is positioned between an integrally joined to side faces 34 and 36. Since side faces 34 and 36 are connected between trapezoidal second portions 22 and 28, the adjacent faces 34, 38 and the adjacent faces 36, 38 meet to form angles between adjacent faces. The angle between adjacent faces 34, 38, and the angle between adjacent faces 36, 38 are preferably equal, and are each greater than 90° but less than 180°. The angle between adjacent faces 34, 38 and the angle between adjacent faces 36, 38 are varied depending on the angle between adjacent sides 32, 36 and 30, 34 to provide that end face 38 remains parallel with opposite end face 40.

End cap 16 may be composed of any suitable translucent material, such as a suitable glass material, and can be formed by any conventional glass forming process known in the art. Although not shown to include the wide variety of possible designs in the figures, the forming process usually includes providing the interior surface of the sides 30, 32, 34, 36 and end face 38 with some type of molded decorative design which is clearly visible through the glass material. This molded decorative design significantly contributes to the overall aesthetic value of end cap 16 as a construction material.

Figure 4:
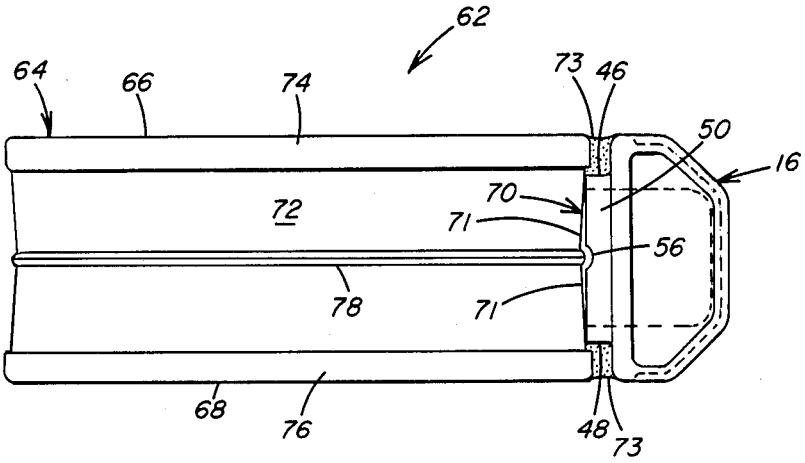
FIG. 4 is a top plan view of a translucent block and a translucent end cap.
Figure 5:
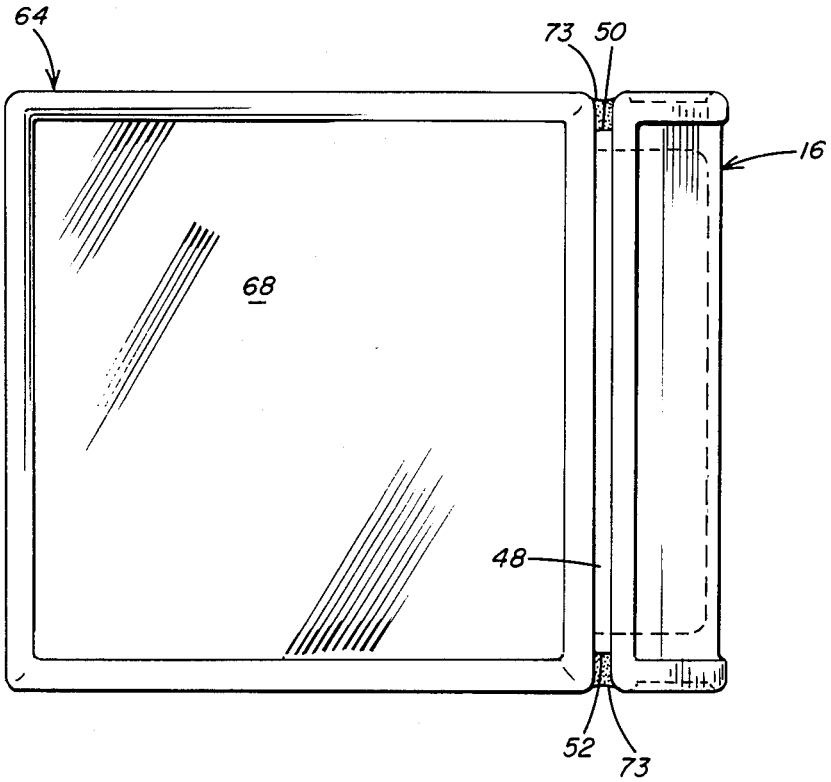
FIG. 5 is a side elevational view of a translucent glass block and a translucent end cap.

Referring to FIGS. 4 and 5, there is illustrated a glass block/end cap arrangement, generally designated by the numeral 62 which includes a glass block 64 and an end cap 16. Glass block 64 is known in the art and is described herein only as it pertains to the present invention.

As seen in FIG. 4, glass block 64 includes a pair of side faces 66, 68, top surface 72 and abutting side surface 70. Although not shown, glass block 64 includes two additional surfaces between side faces 66, 68. Glass block 64 further includes a pair of edge surfaces 74, 76 and a raised surface portion 78 which is formed during the glass block 64 forming process.

As shown in FIGS. 4 and 5, the overall width of end cap 16 substantially equals the overall width of glass block 64, and the overall height of end cap 16 substantially equals the overall height of glass block 64.

End cap 16 is positioned in relation to glass block 64 abutting side surface 70 to provide that the raised surface portion generally designated by the numeral 44 of end cap 16 contacts abutting side surface 70. Specifically, raised surface portion 44 walls 46, 48 contact abutting side surface 70 over their respective lengths. As seen in FIG. 4, since abutting side surface 70 includes a pair of surfaces 71 which each taper inwardly from their respective connecting edge surfaces 74, 76 to raised surface portion 78, only a portion of raised surface portion 44 top wall 50 and bottom wall 52 will contact abutting side surface 70. Where desired, however, top wall 50 and bottom wall 52 may be suitably tapered to provide that these respective walls completely abut abutting side surface 70.

As previously described, top wall 50 and bottom wall 52 each include an arcuately notched portion 56. As seen, the arcuately notched portions 56 positioned in top wall 50 and bottom wall 52 prevent top wall 50 and bottom wall 52 from contacting glass block 64 raised surface portion 78. Similarly, raised surface portion 44 walls 46, 48 are positioned on opposite end face 40 to contact abutting surface 70 inside glass block edge surfaces 74 and 76.

End cap 16 is positioned in relation to block 64 as shown in FIGS. 4 and 5 and is fixedly joined to glass block 64 abutting side surface 70 by a suitable bonding material 73, such as a conventional cementitious material or an acrylic cement. Many types of commercially available bonding materials can be utilized in the present invention, such as a conventional cementitious material, or mortar, including four parts portland cement, three parts lime and 16 parts sand, measured by volume. The mortar can also include a water proofing constituent. Other suitable bonding materials include adhesives, such as silicone. Mortar or other suitable bonding material is layed up between opposite end face 40 of end cap 16 and abutting side surface 70 of glass block 64 to permanently bond end cap 16 to glass block 64.

As seen in FIG. 1, the translucent block wall structure 10 which includes layers of translucent block 12 may each include an end cap 16 permanently bonded to the abutting side surface 70 of each block in the layer. As previously described, each end cap 16 may also include the pair of raised surface portions 60 positioned on upper and lower faces 18 and 24 respectively. Top surface 18 raised surface portion 60 is specifically illustrated in FIGS. 2 and 3, while bottom surface 24 raised surface portion 60 is indicated although not specifically shown. As previously described, raised surface portions may be provided if desired to form additional mortar adhering surfaces between adjacent end caps 16 when it is desired to provide a translucent block wall structure 10 having layers of translucent block 12 each terminating in an end cap 16.

The end cap 16 illustrated in the figures and described herein provides a usable vertical surface for the translucent block wall structure 10 illustrated in FIG. 1. Although not specifically illustrated in FIG. 1, it should be understood that an end cap 16 may be secured to each individual block Top surface 72 in top layer 12 of wall structure 10 to form a usable top layer 12 top surface.

It should further be understood that although an end cap 16 having a specific configuration is described herein, an end cap 16 having any predetermined configuration may be utilized without departing from this invention. For example, end cap 16 top surface 18 and bottom surface 24 may have a rectangular, square, arcuate, or any desired shape. End cap 16 may have any desired ornamental aesthetic external appearance. As earlier described, where desired, end cap 16 may be solid translucent glass.

According to the provisions of the patent statutes, we have explained the principle preferred construction and mode of operation of our invention and have illustrated and described what we now consider to represent its best embodiments. However, it should be understood that, within the scope of the appended claims, the invention may be practiced otherwise than as specifically illustrated and described.

I claim:

1. A translucent end cap for use with a translucent glass block comprising, a pair of top and bottom surfaces spaced from each other, said top and bottom surfaces being substantially parallel and generally having the same preselected shape, a side surface extending between said top and bottom surfaces, said side surface perpendicular and joined to said top and said bottom surfaces, said side surface having a contour generally conforming to said top and said bottom surfaces preselected shape, and a raised rear surface portion extending from said side surface to form a protrusion, a portion of said protrusion arranged to abut a portion of an abutting side surface of a translucent glass block.

2. A translucent end cap for use wih a translucent glass block as set forth in claim 1 which includes, a cavity positioned in said side surface, said cavity forming a generally rectangular opening in said side surface, said cavity extending a preselected distance into said side surface.

3. A translucent end cap for use with a translucent glass block as set forth in claim 1 in which, said raised rear surface portion extends from said side surface around said cavity to form said protrusion.

4. A translucent end cap for use with a translucent glass block as set forth in claim 1 in which, said raised rear surface portion extending from said side surface around said cavity forms a protrusion having a generally rectangular configuration.

5. A translucent end cap for use with a translucent glass block as set forth in claim 1 in which, a portion of said raised rear surface portion abuts a portion of an abutting side surface of a translucent glass block.

6. A translucent end cap for use with a translucent glass block a set forth in claim 1 in which, said raised rear surface portion includes a pair of arcuately notched portions to prevent said raised rear surface portion from contacting a translucent glass block abutting side surface raised surface portion.

7. A translucent end cap for use with a translucent glass block as set forth in claim 1 in which, a portion of said raised rear surface portion abuts a portion of said abutting side surface of said translucent glass block to provide a mortar joint between said side surface and said translucent glass block abutting side surface.

8. A translucent end cap for use with a translucent glass block as set forth in claim 1 in which, said top and said bottom surfaces each have a generally rectangular shape.

9. A translucent end cap for use with a translucent glass block as set forth in claim 1 in which, said top and said bottom surfaces each have a generally arcuate shape.

10. A translucent end cap for use with a translucent glass block as set forth in claim 1 in which, said top and said bottom surfaces each have a generally square shape.

11. A translucent end cap for use with a translucent glass block comprising, a pair of parallel upper and lower faces, each having a generally rectangular first portion and a generally trapezoidal second portion extending from and integral with said generally rectangular first portion, a first pair of generally rectangular, opposing side faces which are parallel with each other and are perpendicular and joined to said upper and said lower faces rectangular first portions, a second pair of generally rectangular side faces which are perpendicular and joined to said upper and said lower faces trapezoidal second portions, one of said first pair of said side faces being joined to one of said second pair of said side faces with a first predetermined angle therbetween, a generally rectangular end face which is perpendicular and joined to said upper and said lower faces trapezoidal second portions, said end face being positioned between and joined to said second pair of side faces with a second predetermined angle between said end face and each of said second pair of said side faces, a generally rectangular opposite end face opposing and parallel with said end face, said opposite end face being perpendicular and joined to said upper and said lower faces rectangular first portions, said opposite end face being positioned between and joined to said first pair of said side faces, and a raised surface portion extending from said opposite end face, a portion of said raised surface portion arranged to abut a portion of an abutting side surface of a translucent glass block.

12. A translucent end cap for use with a translucent glass block as set forth in claim 11 which includes, a cavity positioned in said opposite end face, said cavity forming a generally rectangular opening in said opposite end face, said cavity extending a preselected distance into said opposite end face.

13. An end cap for use with a translucent glass block as set forth in claim 11 in which, said raised surface portion extends from said opposite end face around said cavity to form a protrusion having a generally rectangular configuration.

14. A translucent end cap for use with a translucent glass block as set forth in claim 11 in which, said raised surface portion includes a pair of arcuatley notched portions to prevent said raised surface portion from contacting a translucent glass block abutting side surface raised surface portion.

15. A translucent end cap for use with a translucent glass block as set forth in claim 11 in which, a portion of said raised surface portion contacts a portion of said abutting side surface of said translucent glass block to provide a mortar joint between said opposite end face and said translucent glass block abutting side surface.

16. An end cap for use with a translucent glass block as set forth in claim 11 in which, said first predetermined angle between one of said first pair of said side faces and one of said second pair of said side faces is greater than 90° and less than 180°.

17. An end cap for use with a translucent glass block as set forth in claim 10 in which, said second predetermined angle between said end face and each of said second pair of said side faces is greater than 90° and less than 180°.

* * * * *